US010272686B2

(12) United States Patent
Naganuma et al.

(10) Patent No.: US 10,272,686 B2
(45) Date of Patent: Apr. 30, 2019

(54) MEMS DEVICE, LIQUID EJECTING HEAD, MANUFACTURING METHOD OF MEMS DEVICE, AND MANUFACTURING METHOD OF LIQUID EJECTING HEAD

(71) Applicant: SEIKO EPSON CORPORATION, Tokyo (JP)

(72) Inventors: Yoichi Naganuma, Matsumoto (JP); Shuichi Tanaka, Chino (JP); Eiju Hirai, Azumino (JP); Toshiaki Hamaguchi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 29 days.

(21) Appl. No.: 15/628,464

(22) Filed: Jun. 20, 2017

(65) Prior Publication Data

US 2017/0368828 A1 Dec. 28, 2017

(30) Foreign Application Priority Data

Jun. 28, 2016 (JP) ..... 2016-127301

(51) Int. Cl.
*B41J 2/16* (2006.01)
*B41J 2/14* (2006.01)

(52) U.S. Cl.
CPC ..... *B41J 2/1623* (2013.01); *B41J 2/14233* (2013.01); *B41J 2/161* (2013.01); *B41J 2/1607* (2013.01); *B41J 2/1626* (2013.01); *B41J 2/1629* (2013.01); *B41J 2/1631* (2013.01); *B41J 2/1634* (2013.01); *B41J 2/1643* (2013.01); *B41J 2/1645* (2013.01); *B41J 2002/14241* (2013.01); *B41J 2002/14491* (2013.01); *B41J 2202/11* (2013.01); *B41J 2202/18* (2013.01)

(58) Field of Classification Search
CPC ..... B41J 2/1623
See application file for complete search history.

(56) References Cited

U.S. PATENT DOCUMENTS

2010/0216260 A1* 8/2010 Takahashi ..... B41J 2/161 438/10

FOREIGN PATENT DOCUMENTS

JP 2008-246835 A 10/2008
JP 2015-136898 A 7/2015

* cited by examiner

*Primary Examiner* — Errol V Fernandes
(74) *Attorney, Agent, or Firm* — Workman Nydegger

(57) ABSTRACT

There is provided an MEMS device in which a first substrate provided with a driving element and a second substrate protecting the driving element are bonded to each other with an adhesive, in which the driving element is formed inside the space surrounded by the adhesive between the first substrate and the second substrate, an open hole which communicates with the space and the outside of the adhesive is formed on the adhesive, and an end of the outside of the open hole is provided to be with an end of the first substrate and an end of the second substrate.

6 Claims, 9 Drawing Sheets

MEMS DEVICE, LIQUID EJECTING HEAD, MANUFACTURING METHOD OF MEMS DEVICE, AND MANUFACTURING METHOD OF LIQUID EJECTING HEAD

BACKGROUND

1. Technical Field

The entire disclosure of Japanese Patent Application No: 2016-127301, filed Jun. 28, 2016 is expressly incorporated by reference herein in its entirety.

The present invention relates to an MEMS device including a structure in which two substrates are bonded to each other using an adhesive, a liquid ejecting head, a manufacturing method of the MEMS device, and a manufacturing method of the liquid ejecting head.

2. Related Art

As a micro electro mechanical systems (MEMS) device being applied to a liquid ejecting head, or the like, a device in which two substrates are bonded to each other using an adhesive with a gap therebetween is used. A space surrounded by the adhesive is formed between two substrates of the MEMS device. Also, a driving element such as a piezoelectric element is formed inside the space. As such a manufacturing method of the MEMS device, a method of dividing two mother substrates in which a plurality of regions which respectively become an individual MEMS device are bonded to each other into the individual MEMS device is known (for example, refer to JP-A-2008-246835). Moreover, the space inside the MEMS device communicates with a space (for example, atmosphere) of the outside of the MEMS device through an open hole (atmosphere communicating hole in JP-A-2008-246835) which is opened in a part of the adhesive.

However, in JP-A-2008-246835, in the mother substrate before being divided into an individual liquid droplet discharging head (that is, the MEMS device), the adhesive is removed along a division line which becomes a boundary of the individual liquid droplet discharging head. Therefore, the liquid droplet discharging head (that is, the MEMS device) after dividing has a structure, in which the adhesive is disposed in the inside further than an outer shape of the liquid droplet discharging head, and the atmosphere communicating hole (that is, open hole) is opened to the inside further than the outer shape of the liquid droplet discharging head. That is, the structure is that an end of the liquid droplet discharging head (that is, substrate) is positioned on the outside further than an adhesive region where the adhesive is disposed. As a result, a useless space is generated between the end of the adhesive and the end of the substrate, and thus there is a concerned that the MEMS device becomes large as much. Also, if the MEMS device becomes large, the number of the MEMS devices manufactured form one mother substrate is reduced.

SUMMARY

An advantage of some aspects of the invention is to provide an MEMS device which is able to be miniaturized, a liquid ejecting head, a manufacturing method of the MEMS device, and a manufacturing method of the liquid ejecting head.

According to an aspect of the invention, there is provided an MEMS device in which a first substrate provided with a driving element and a second substrate protecting the driving element are bonded to each other with an adhesive, in which the driving element is formed inside the space surrounded by the adhesive between the first substrate and the second substrate, an open hole which communicates with the space and the outside of the adhesive is formed on the adhesive, and an end of the outside of the open hole is provided to be with an end of the first substrate and an end of the second substrate.

According to the aspect of the invention, the end of the outside of the open hole (that is, end of outside of adhesive) is provided to be with the end of the first substrate and the end of the second substrate, and thus the MEMS device can be miniaturized while securing a sufficient adhesive region.

In the configuration described above, it is preferable that the first substrate be configured with a main substrate and a stacked member which is stacked on the main substrate, and an end of the main substrate be provided to be with the end of the outside of the open hole.

According to this configuration, strength of the end of the outside of the open hole of the MEMS device can be secured.

In the configuration described above, it is preferable that the first substrate include an overlapping part overlapping with at least open hole in a stacking direction of the first substrate, the adhesive, and the second substrate, and an end of the overlapping part of the main substrate be provided to be with the end of the second substrate, and an end of a part deviated from the overlapping part of the main substrate is formed on the inside further than the end of the second substrate.

According to this configuration, the end of the part deviated from the overlapping part of the main substrate is formed on the outside further than the end of the second substrate, the MEMS device is easily manufactured. That is, when the two mother substrates which are bonded to each other are divided into the individual substrate, division is easily performed. In addition, the end of the overlapping part overlapping with the open hole is provided to be with the end of the second substrate, in a state before being divided from the mother substrate, strength of the overlapping part overlapping with the open hole can be increased. Accordingly, in the overlapping part which is a part in which the strength is likely to be weakened, generation of cracks, clefts, or the like can be suppressed. Further, a thickness of at least a part of the overlapping part is thinner than a thickness of a part deviated from the overlapping part, and thus the two mother substrates which are bonded to each other are further easily divided into an individual substrate.

According to another aspect of the invention, there is provided a liquid ejecting head including a structure of the MEMS device in any one of the configurations, in which the driving element is a piezoelectric element, the first substrate is a substrate including a pressure chamber forming substrate in which a pressure chamber is provided on a region corresponding to the piezoelectric element, and the open hole is an atmosphere open hole which opens a space to an atmosphere.

According to this configuration, the liquid ejecting head can be miniaturized.

According to still another aspect of the invention, there is provided a manufacturing method of an MEMS device in which a first substrate provided with a driving element and a second substrate protecting the driving element are bonded to each other with an adhesive having photosensitivity, the driving element is formed on the inside of the space surrounded by the adhesive between the first substrate and the second substrate, and an open hole is formed on the adhesive which communicates with the inside and the outside of the space, the method including forming an adhesive to any one of a first mother substrate including the first substrate and a second mother substrate including the second substrate, bonding the first mother substrate and the second mother substrate using the adhesive, and dividing the bonded substrate of which the first mother substrate and the second mother substrate are bonded to each other into an individual bonded substrate of which the first mother substrate and the second mother substrate are bonded to each other, in which, in a state before the bonded substrate is divided into the individual bonded substrate, between the first mother substrate and the second mother substrate, a plurality of individual spaces are formed, and the adjacent spaces communicate with each other through a process open hole formed on the adhesive, and, in the dividing, the individual open hole corresponding to the individual bonded substrate is formed by dividing the process open hole.

According to the manufacturing method, the miniaturized MEMS device can be manufactured. In addition, the adjacent spaces communicate with each other through the process open hole formed on the adhesive, and thus each space can be opened to the outside of the mother substrate through the penetration hole (atmosphere open hole) formed on the outside of a substrate region which becomes either of the first substrate or the second substrate of the mother substrate. As a result, at the time of applying heat to the adhesive, air inside the space can be missed to the outside of the mother substrate. In addition, compared a case in which the penetration hole is provided in each substrate region, deterioration of the strength of the mother substrate can be suppressed.

In the manufacturing method described above, the method further includes, after the bonding substrate, removing the first mother substrate on a region deviated from a region corresponding to the open hole in a division line which is a boundary of the individual first substrate, from a surface opposite to the second mother substrate in the plate thickness direction, before the dividing.

According to the manufacturing method, when the two mother substrates which are bonded to each other in the dividing are divided into the individual substrate, the division is easily performed. In addition, in a state before the mother substrate is divided, generation of cracks, clefts, or the like in a region corresponding to the open hole in which the strength is easily weakened can be suppressed.

According to yet still another aspect of the invention, there is provided a manufacturing method of a liquid ejecting head to which the method is applied in any one of the manufacturing methods described above in which a driving element is a piezoelectric element, a first substrate is a substrate including a pressure chamber forming substrate in which a pressure chamber is provided in a region corresponding to the piezoelectric element, and the open hole is an atmosphere open hole which opens a space to the atmosphere.

According to the manufacturing method, a miniaturized liquid ejecting head can be manufactured.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
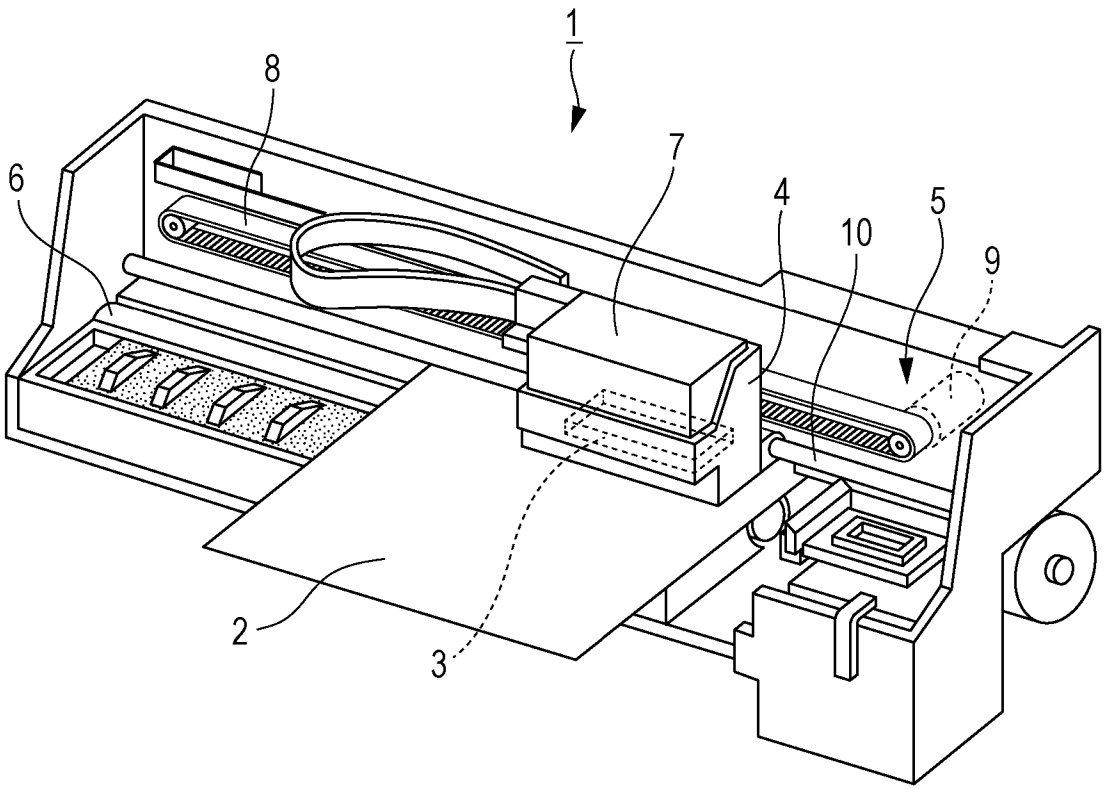
FIG. 1 is a perspective view describing a configuration of a printer.

Hereinafter, embodiments for carrying out the invention will be described with reference to attached drawings. Also, various limitations are made as a preferred specific example of the invention in the embodiments to be described later, but a scope of the invention is not limited to aspects thereof unless particularly there is no disclosure which intends to limit the invention in description to be described later. In addition, hereinafter, a liquid ejecting head which is in one category of the MEMS device, particularly, an ink jet type recording head (hereinafter, recording head) 3 which is a type of the liquid ejecting head will be exemplified. FIG. 1 is a schematic view of an ink jet type printer (hereinafter, printer) 1 which is a type of a liquid ejecting apparatus mounted in the recording head 3.

The printer 1 is a device which records an image, or the like by ejecting ink (a type of liquid) to a surface of a recording medium 2 (a type of object to which the ink is landed) such as recording paper. The printer 1 is provided with the recording head 3, a carriage 4 provided in the recording head 3, a carriage moving mechanism 5 which moves the carriage 4 in a main scanning direction, a transporting mechanism 6 which transports the recording medium 2 in a sub scanning direction, and the like. Here, the ink is stored in an ink cartridge 7 as a liquid supplying source. The ink cartridge 7 is detachably mounted to the recording head 3. Also, a configuration can be adopted, in which the ink cartridge is disposed on a main body side of the printer, and the ink is supplied from the ink cartridge to the recording head through an ink supplying tube.

The carriage moving mechanism 5 is provided with a timing belt 8. The timing belt 8 is driven by a pulse motor 9 such as a DC motor. Therefore, when the pulse motor 9 is operated, the carriage 4 is guided by a guide rod 10 installed in the printer 1, and is reciprocated in the main scanning direction (width direction of recording medium 2). A position of the main scanning direction of the carriage 4 is detected by a linear encoder (not illustrated) which is a type of position information detecting means. The linear encoder transmits a detection signal, that is, an encoder pulse (type of position information) to a controller of the printer 1.

Figure 2:
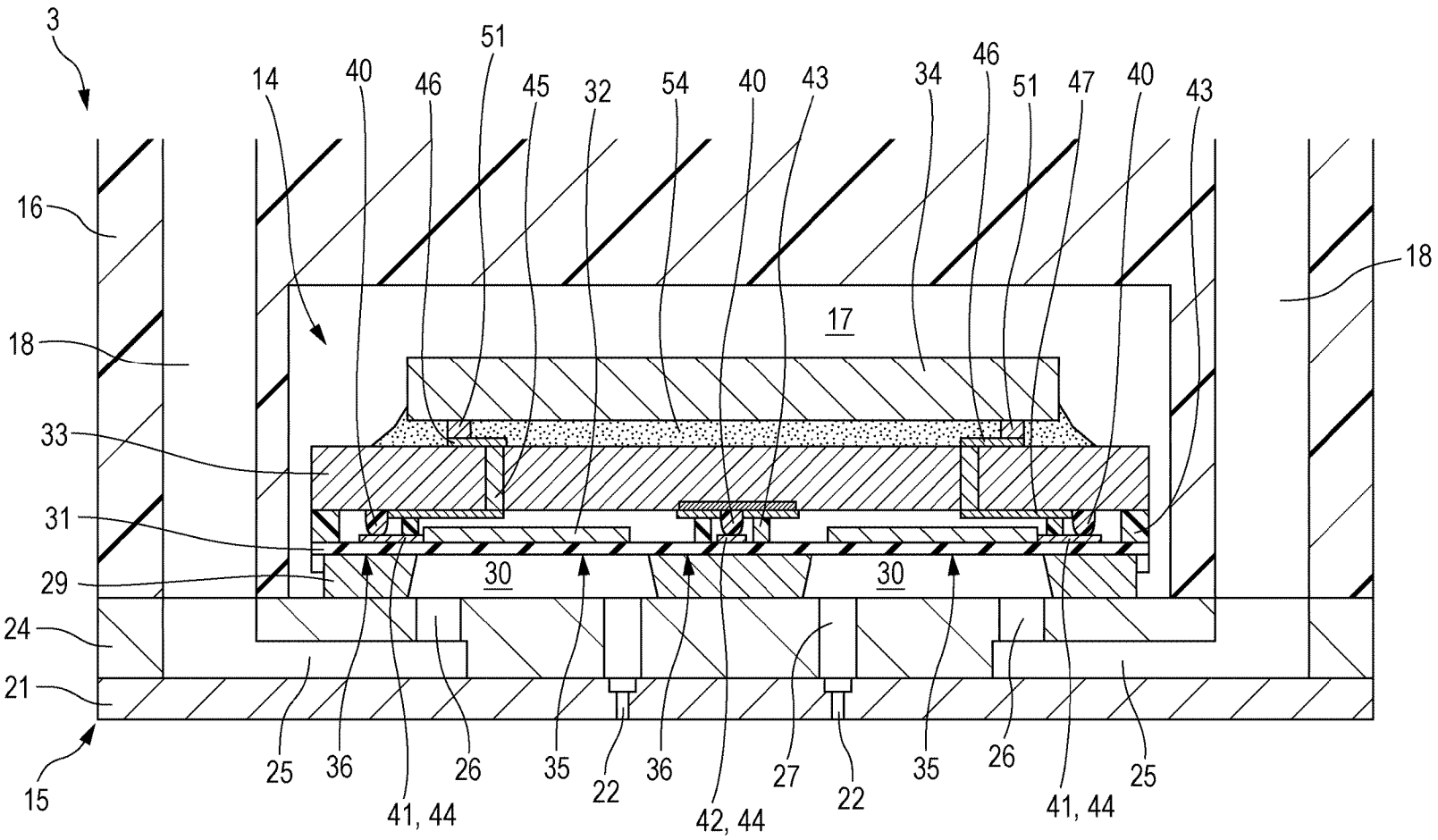
FIG. 2 is a sectional view describing a configuration of a recording head.
Figure 3:
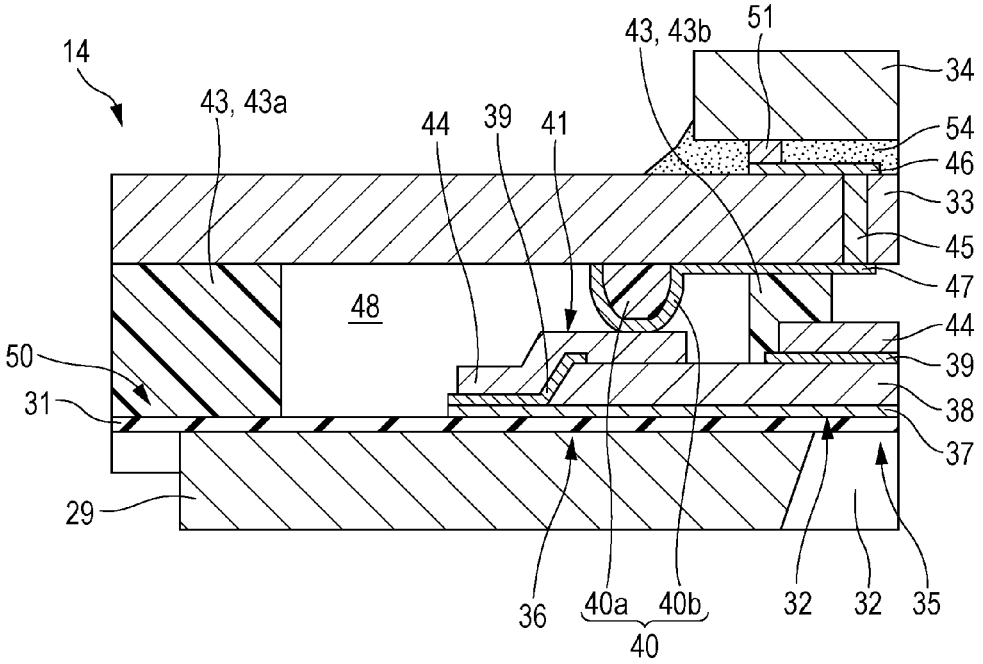
FIG. 3 is a sectional view of an enlarged main part of an actuator unit.
Figure 4:
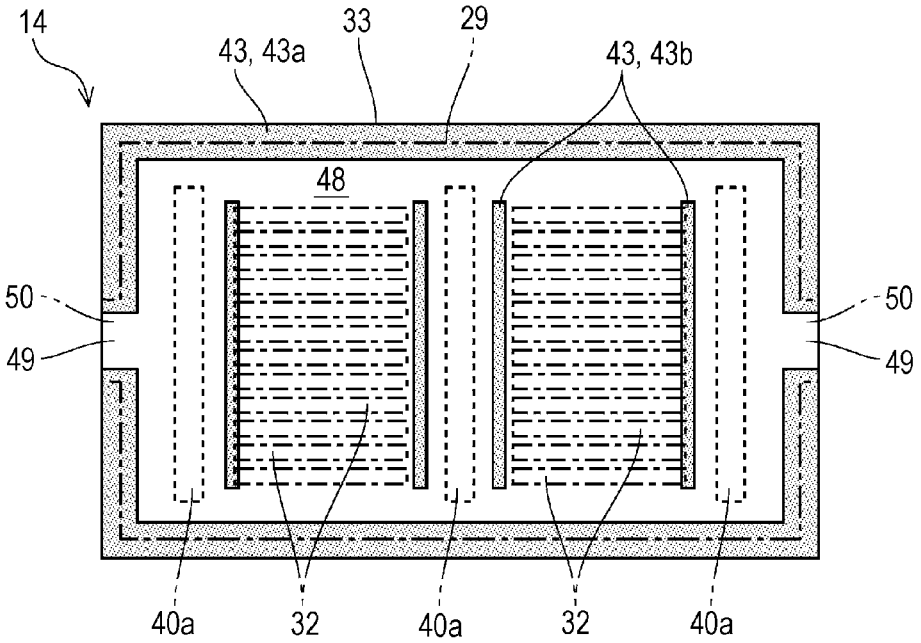
FIG. 4 is a plan view schematically illustrating the actuator unit.

Next, the recording head 3 will be described. FIG. 2 is a sectional view describing a configuration of the recording head 3. FIG. 3 is a sectional view of which an end portion (end portion on a left side in FIG. 2) of one side of the actuator unit 14 is enlarged. FIG. 4 is a plan view schematically illustrating the actuator unit 14. Also, for the sake of convenience, a stacking direction of each member constituting the actuator unit 14 will be described as an up and down direction. In addition, in FIG. 4, for convenience of description, configurations other than an adhesive 43, a piezoelectric element 32, and a resin 40*a* of a bump electrode 40 will be omitted. As illustrated in FIG. 2, the recording head 3 of the embodiment in a state in which the actuator unit 14 and a flow passage unit 15 are stacked therein is provided in a head case 16.

The head case 16 is a box-shaped member made of synthetic resin, and inside the head case, a liquid introduction passage 18 which supplies ink to each pressure chamber 30 is formed. The liquid introduction passage 18 is a space, in which common ink to the pressure chamber 30 which is formed in multiple is stored, with the common liquid chamber 25 to be described later. In the embodiment, liquid introduction passages 18 are formed in two rows corresponding to rows of the pressure chambers 30 which are arranged in two rows. In addition, an accommodation space 17, which is recessed in a rectangular parallelepiped shape from the lower surface to an intermediate of a height direction of the head case 16, is formed on a lower surface side of the head case 16. When the flow passage unit 15 to be described is bonded to a lower surface of the head case 16 in a state in which a position thereof is determined, the actuator unit 14 (pressure chamber forming substrate 29, sealing plate 33, driving IC 34, and the like) stacked on a communication substrate 24 is configured to be accommodated inside the accommodation space 17. Further, illustration will be omitted, but an insertion hole through, which a wiring substrate such as a flexible printed circuit board (FPC) transmitting a driving signal to the driving IC 34 from the controller is inserted, is formed in the head case 16. The accommodation space 17 communicates with the atmosphere through the insertion hole.

The flow passage unit 15 bonded to the lower surface of the head case 16 includes the communication substrate 24 and a nozzle plate 21. The communication substrate 24 is a substrate (for example, silicon single crystal substrate) made of silicon constituting an upper portion of the flow passage unit 15. As described above FIG. 2, an individual communication passage 26 which communicates with the liquid introduction passage 18 and individually supplies the ink from each pressure chamber 30 to each pressure chamber 30, the nozzle communication passage 27 which communicates the pressure chamber 30 with a nozzle 22 are formed on the communication substrate 24 by anisotropic etching, or the like. The common liquid chamber 25 is an empty space elongated along a nozzle row direction, and is formed in two rows corresponding to rows of the pressure chambers 30 which are formed in two rows.

The nozzle plate 21 is a substrate (for example, silicon single crystal substrate) made of silicon which is bonded to a lower surface (a surface of a side opposite to the pressure chamber forming substrate 29) of the communication substrate 24. In the embodiment, an opening on a lower surface side of a space which is the common liquid chamber 25 is sealed by the nozzle plate 21. In addition, a plurality of the nozzles 22 are opened in a linear shape (in a row) on the nozzle plate 21. In the embodiment, nozzle rows are formed in two rows corresponding to the rows of the pressure chamber 30 which are formed in two rows. The arranged plurality of the nozzles 22 (nozzle rows) are provided at equivalent intervals along the sub scanning direction orthogonal to the main scanning direction, at a pitch corresponding to a dot formation density from one end side of the nozzle 22 to another end side of the nozzle 22. Also, the opening of the lower surface side of the space which is the common liquid chamber can be sealed with, for example, a member such as a compliance sheet, or the like having a flexibility by bonding the nozzle plate to a region deviated from an inside from the common liquid chamber in the communication substrate. Accordingly, the nozzle plate can be minimized as soon as possible.

As illustrated in FIG. 2 and FIG. 3, the actuator unit 14 of the embodiment becomes a unit by stacking the pressure chamber forming substrate 29, a vibration plate 31, the piezoelectric element 32, the sealing plate 33 and the driving IC 34. Also, the actuator unit 14 is formed to be smaller than the accommodation space 17 so as to be able to be accommodated inside the accommodation space 17.

The pressure chamber forming substrate 29 is a hard plate made of silicon, and in the embodiment, the substrate is made of silicon single crystal substrate in which a crystal plane orientation of a surface (upper surface and lower surface) is set to a (110) plane. A part of the substrate is completely removed by anisotropic etching, or the like in the plate thickness direction in the pressure chamber forming substrate 29, and a plurality of spaces which become the pressure chamber 30 are arranged along the nozzle row direction. In this space, a lower side thereof is partitioned by the communication substrate 24, and an upper side thereof is partitioned by the vibration plate 31, so that the pressure chamber 30 is configured. In addition, in the space, that is, the pressure chamber 30 is formed in two rows corresponding to the nozzle rows which are formed in two rows. Each pressure chamber 30 is an empty space elongated in a direction orthogonal to the nozzle row direction, and the individual communication passage 26 communicates with an end portion of one side of a longitudinal direction and the nozzle communication passage 27 communicates with an end portion of another side of the direction.

As illustrated in FIG. 4, an outer shape of the pressure chamber forming substrate 29 in the embodiment is formed slightly smaller than an outer shape of the sealing plate 33 in a plan view. Specifically, an end of the pressure chamber forming substrate 29 is formed inside more than an end of the sealing plate 33 in a range of overlapping with an outer circumference adhesive 43*a*. In addition, an overlapping part 50 at least overlapping with a part which becomes an open hole 49 to be described later without the outer circumference adhesive 43*a* disposed thereon is protruded to the outside from the outer shape of the pressure chamber forming substrate 29, and an end of the outside thereof (side opposite to piezoelectric element 32) and an end of the outside of the sealing plate 33 are provided to be with. In brief, the end of the pressure chamber forming substrate 29 is provided to be with an end of the outside of the open hole 49 and the end of the sealing plate 33 in the overlapping part 50. In addition, a length of the overlapping part 50 in the embodiment (in detail, a length of a direction orthogonal to the nozzle row direction or a protruding direction of the overlapping part 50 with respect to a main body of the pressure chamber forming substrate 29) is formed to be longer than a length of the open hole 49. Further, as illustrated in FIG. 3, a thickness (in details, a size in a stacking direction of a the pressure chamber forming substrate 29, the adhesive 43, and the sealing plate 33) of at least a part of the overlapping part 50 (Specifically, in the overlapping part 50, a part deviated to the outside further than an outer shape of a part (in other words, another part) in which a position in the direction orthogonal to the nozzle row direction is deviated from the overlapping part 50) is thinner than a thickness of another part.

The vibration plate 31 is a thin film shape member having elasticity, and is stacked on an upper surface of the pressure chamber forming substrate 29 (surface opposite to communication substrate 24 side). In the embodiment, an outer shape of the vibration plate 31 is provided to be therewith in the same size as the outer shape of the sealing plate 33. An upper opening of a space which becomes the pressure chamber 30 is sealed with the vibration plate 31. In other words, the pressure chamber 30 is partitioned by the vibration plate 31. A part corresponding to the pressure chamber 30 (more specifically, upper portion opening of pressure chamber 30) in the vibration plate 31 functions as a displacement portion which is displaced in a direction distant away from or a direction close to the nozzle 22 according to bending deformation of the piezoelectric element 32. That is, a region corresponding to the upper portion opening of the pressure chamber 30 in the vibration plate 31 is a drive region 35 where bending deformation is allowed. Meanwhile, a region deviated from the upper portion opening of the pressure chamber 30 in the vibration plate 31 is the non-drive region 36 where bending deformation is inhibited.

Moreover, the vibration plate 31 is configured with, for example, an elastic film made of silicon dioxide ($SiO_2$) formed on an upper surface of the pressure chamber forming substrate 29 and an insulating body film made of zirconium oxide ($ZrO_2$) formed on the elastic film. Also, the piezoelectric elements 32 which are a type of driving elements are respectively stacked on a region corresponding to each pressure chamber 30 on an insulating film (surface opposite to pressure chamber forming substrate 29 side of vibration plate 31), that is, the drive region 35. The piezoelectric elements 32 are formed in two rows in the nozzle row direction corresponding to the pressure chambers 30 which are arranged in two rows along the nozzle row direction. Also, the pressure chamber forming substrate 29 corresponds to a main substrate in the invention, and the vibration plate 31 corresponds to a stacked member in the invention. In addition, the pressure chamber forming substrate 29 and the vibration plate 31 (that is, pressure chamber forming substrate 29 in which vibration plate 31 is stacked) correspond to a first substrate in the invention.

The piezoelectric element 32 of the embodiment is a piezoelectric element of a so called bending mode. As illustrated in FIG. 3, in the piezoelectric element 32, for example, a lower electrode layer 37, a piezoelectric layer 38, and an upper electrode layer 39 are sequentially stacked on the vibration plate 31. The piezoelectric element 32 configured in such a manner is bent and deformed in a direction distant from or a direction close to the nozzle 22, when an electric field corresponding to a potential difference of both electrodes is applied between the lower electrode layer 37 and the upper electrode layer 39. In the embodiment, the lower electrode layer 37 is an individual electrode which is independently formed in each piezoelectric element 32, and the upper electrode layer 39 is a common electrode which is continuously formed through a plurality of the piezoelectric elements 32. That is, the lower electrode layer 37 and the piezoelectric layer 38 are formed in each pressure chamber 30. Meanwhile, the upper electrode layer 39 is formed though a plurality of the pressure chambers 30. Also, depending on a driving circuit or a wiring, the lower electrode layer (that is, electrode layer of lower layer) can be set a common electrode, and the upper electrode layer (that is, electrode layer of upper layer) can be set an individual electrode.

One side of the lower electrode layer 37 (the outside of pressure chamber forming substrate 29) extends to the outside further than the piezoelectric layer 38 in the direction orthogonal to the nozzle row direction. That is, an end portion of one side of the lower electrode layer 37 is exposed from the piezoelectric layer 38, and an individual terminal 41 is stacked on the exposed part. The individual terminal 41 in the embodiment is configured with the upper electrode layer 39 formed distant away from the piezoelectric element 32 in the direction orthogonal to the nozzle row direction and a metal layer 44 stacked on the upper electrode layer 39. At least the metal layer 44 among layers constituting the individual terminal 41 extends to a top of the piezoelectric layer 38. The bump electrode 40 to be described later is connected to the metal layer 44 stacked on the piezoelectric layer 38. Moreover, the metal layer 44 is also stacked on the end portion in the longitudinal direction (that is, the direction orthogonal to the nozzle row direction) of the piezoelectric element 32. That is, the metal layer 44 is stacked so as to cross a boundary of the drive region 35 and the non-drive region 36. Accordingly, excessive deformation of the end portion of the piezoelectric element 32 is suppressed, and thus damage of the piezoelectric layer 38, and the like can be suppressed in the boundary of the drive region 35 and the non-drive region 36.

In addition, in the embodiment, the upper electrode layer 39 extended from a row of the piezoelectric element 32 on one side and the upper electrode layer 39 extended from a row of the piezoelectric element 32 on another side are connected on the non-drive region 36 between the rows of the piezoelectric element 32 (not illustrated). That is, the upper electrode layer 39, which is common to the piezoelectric element 32 of both sides, is formed on the non-drive region 36 between the rows of the piezoelectric element 32. As illustrated in FIG. 2, the metal layer 44 which is the common terminal 42 is stacked on the upper electrode layer 39. Also, the corresponding bump electrode 40 is connected to the metal layer 44.

Also, as the lower electrode layer 37 and the upper electrode layer 39*b* described above, various metals such as iridium (Ir), platinum (Pt), titanium (Ti), tungsten (W), nickel (Ni), palladium (Pd), and gold (Au), alloys thereof, alloys such as $LaNiO_3$, and the like are used. In addition, as the piezoelectric layer 38, a ferroelectric piezoelectric material such as lead zirconate titanate (PZT), and a relaxor ferroelectric to which metals such as niobium (Nb), nickel (Ni), magnesium (Mg), bismuth (Bi), and yttrium (Y) are added, and the like are used. Other than, a non-lead material such as barium titanate can be also used. Further, as the metal layer 44, titanium (Ti), nickel (Ni), chromium (Cr), tungsten (W), and a layer in which gold (Au), copper (Cu), and the like are stacked on an adhesion layer made of an alloy thereof, or the like are used.

As illustrated in FIG. 2, the sealing plate 33 (corresponding to second substrate in the invention) is a flat plate type silicon substrate in which intervals are opened to the piezoelectric element 32, in a state in which the adhesive 43 is interposed between the sealing plate and the piezoelectric element 32. The sealing plate 33 protects the piezoelectric element 32. The sealing plate 33 in the embodiment is manufactured from a silicon single crystal substrate in which a crystal plane orientation of a surface (upper surface and lower surface) is set to (110) plane. In addition, a plurality of the bump electrodes 40 which output a driving signal from the driving IC 34 to the piezoelectric element 32 side are formed on a lower surface (surface of the pressure chamber forming substrate 29 side) of the sealing plate 33 in the embodiment. As illustrated in FIG. 2, the plurality of bump electrodes 40 are respectively formed along the nozzle row direction at a position corresponding to the individual terminal 41 of one side formed on the outside of the piezoelectric element 32 of one side, a position corresponding to the individual terminal 41 of another side formed on the outside of the piezoelectric element 32 of another side, and a position corresponding to the common terminal 42 formed between the rows of the piezoelectric element 32. Also, each bump electrode 40 is connected to the metal layer 44 (specifically, individual terminal 41 or common terminal 42) which corresponds to each bump electrode.

The bump electrode 40 of the embodiment has elasticity, and is protruded toward the vibration plate 31 side from a surface of the sealing plate 33. Specifically, as illustrated in FIG. 3, the bump electrode 40 is provided with the resin 40*a* having elasticity and a conductive film 40*b* covers a surface of at least part of the resin 40*a*. As illustrated in FIG. 4, the resin 40*a* is protruded along the nozzle row direction (in other words, arranged direction of the piezoelectric element 32) on the surface of the sealing plate 33. In addition, the conductive film 40*b* conducting to the individual terminal 41 corresponds to the piezoelectric element 32, and is arranged along the nozzle row direction. Each conductive film 40*b* extends in the direction orthogonal to the nozzle row direction, and becomes a lower surface side wiring 47 which is formed on a lower surface of the sealing plate 33. In other words, each conductive film 40*b* is connected to the lower surface side wiring 47. Also, an end portion opposite to the bump electrode 40 of the lower surface side wiring 47 is connected to the penetration wiring 45. The penetration wiring 45 is a wiring for relaying between the lower surface and the upper surface of the sealing plate 33, and a conductor such as metal is formed inside a penetration hole penetrating the sealing plate 33 in the plate thickness direction. The end portion of the upper surface of the penetration wiring 45 is connected to a corresponding upper surface side wiring 46. The upper surface side wiring 46 extends to a position corresponding to an IC terminal 51 of the driving IC 34 from the penetration wiring 45, and is connected to the IC terminal 51 at the corresponding position. In addition, the conductive film 40*b* conducting to the common terminal 42 is not illustrated, but extends to the outside of the resin 40*a* in the nozzle row direction, and is connected to the penetration wiring 45. Also, the conductive film is connected to the upper surface side wiring 46 through the penetration wiring 45, and is connected to a wiring substrate such as a flexible printed circuit board (FPC). Moreover, it is not limited to a bump electrode including resin. A bump electrode which is made of only metal not including resin therein or a bump electrode made of solder may be adopted.

As illustrated in FIG. 4, the adhesive 43 bonding the pressure chamber forming substrate 29 in which the vibration plate 31 and the piezoelectric element 32 are stacked with the sealing plate 33 is provided to the outer peripheral part of the sealing plate 33 and both end parts of the piezoelectric element 32 in the direction orthogonal to the nozzle row direction. An end of the outside of the outer circumference adhesive 43*a* provided in the outer peripheral part of the sealing plate 33 is provided to be with an end of the outside of the sealing plate 33. The piezoelectric element 32 is disposed in a space 48 surround by the outer circumference adhesive 43*a*, the pressure chamber forming substrate 29, and the sealing plate 33. That is, the piezoelectric element 32 is formed inside the space 48 surround by the outer circumference adhesive 43*a* between the pressure chamber forming substrate 29 and the sealing plate 33. In addition, the open hole 49 communicating with the outside and the inside of the space 48 is provided on the outer circumference adhesive 43*a*. The open hole 49 in the embodiment is opened in the approximately center in the nozzle row direction of the outer circumference adhesive 43*a* provided on the both sides in the direction orthogonal to the nozzle row direction of the actuator unit 14. The space 48 where the piezoelectric element 32 is disposed and the accommodation space 17 are communicated with each other by the open hole 49. Also, since the accommodation space 17 communicates with the atmosphere, the space 48 is opened to the atmosphere. In brief, the open hole 49 in the embodiment functions as an atmosphere open hole which opens the space 48 to the atmosphere. The end of the outside of the open hole 49 is provided to be with an end of the overlapping part 50 of the pressure chamber forming substrate 29, the end of the vibration plate 31, and the end of the sealing plate 33. In addition, the adhesive 43*b* inside the space provided in the both end parts of the piezoelectric element 32 extends along an extending direction of the resin 40*a* of the bump electrode 40. Moreover, the adhesive 43*b* inside the space is not limited to disposing exemplified in the embodiment, and can be disposed at an arbitrary position in accordance with disposing of the wirings or the piezoelectric element 32.

Here, as the adhesive 43 in the embodiment, an adhesive having photosensitivity and thermosetting properties are used. As such an adhesive 43, a resin in which, for example, epoxy resin, acrylic resin, phenol resin, polyimide resin, silicone resin, styrene resin, and the like are included as a main component is suitably used. The pressure chamber forming substrate 29 on which the vibration plate 31, and the like are stacked and the sealing plate 33 are bonded to each other by the adhesive 43 with a gap.

The driving IC 34 is an IC chip for driving the piezoelectric element 32, and is stacked on an upper surface of the sealing plate 33 with the adhesive 54 such as an anisotropic conductive film (ACF). As illustrated in FIG. 2 and FIG. 3, a plurality of the IC terminals 51, which are connected to a terminal portion of the upper surface side wiring 46 on a lower surface (surface of sealing plate 33 side) of the driving IC 34, are formed. The IC terminals 51 are arranged in the nozzle row direction by being corresponded to the individual terminal 41. In the embodiment, the rows of the IC terminals 51 are formed in two rows corresponding to the rows of the piezoelectric elements 32 which are arranged in two rows.

Also, the recording head 3 formed as described above introduces the ink from the ink cartridge 7 to the pressure chamber 30 through the liquid introduction passage 18, the common liquid chamber 25, the individual communication passage 26, and the like. In this state, when a driving signal from the driving IC 34 is supplied to the piezoelectric element 32 through the bump electrode 40, and the like, the piezoelectric element 32 is driven and pressure fluctuation is generated in the ink inside the pressure chamber 30. The recording head 3 ejects ink droplets from the nozzle 22 by using the pressure fluctuation.

As described above, the recording head 3 of the invention is provided to be with an end (that is, end of the outside of adhesive) of the outside of the open hole 49, an end of the sealing plate 33, and an end of the pressure chamber forming substrate 29 on which the vibration plate 31 is stacked, and thus the actuator unit 14 can be miniaturized while securing a sufficient adhesive region. As a result, the recording head 3 can be miniaturized. In addition, the end of the pressure chamber forming substrate 29 is provided to be with the end of the outside of the open hole 49, strength of the end of the outside of the open hole 49 of the actuator unit 14 can be secured. Further, an end of a part deviated from the overlapping part 50 of the pressure chamber forming substrate 29 is formed on the inside further than the end of the second substrate, and thus the actuator unit 14 is easily manufactured. That is, when the two bonded mother substrates are divided into the individual actuator unit 14, dividing is easily performed. Also, regarding a manufacturing method of the actuator unit 14 will be described in detail. Also, the end of the overlapping part 50 overlapping with the open hole 49 provided to be with the end of the second substrate, and thus, in a state before being divided from the mother substrate, strength of the overlapping part 50 overlapping with the open hole 49 can be increased. Accordingly, generation of cracks, clefts, or the like in the overlapping part 50 which is a part where the strength is easily weakened can be suppressed. Further, since a thickness of at least a part of the overlapping part 50 is thinner than a thickness of a part deviated from the overlapping part 50, the two bonded mother substrates are more easily divided into an individual actuator unit 14.

Figure 5:
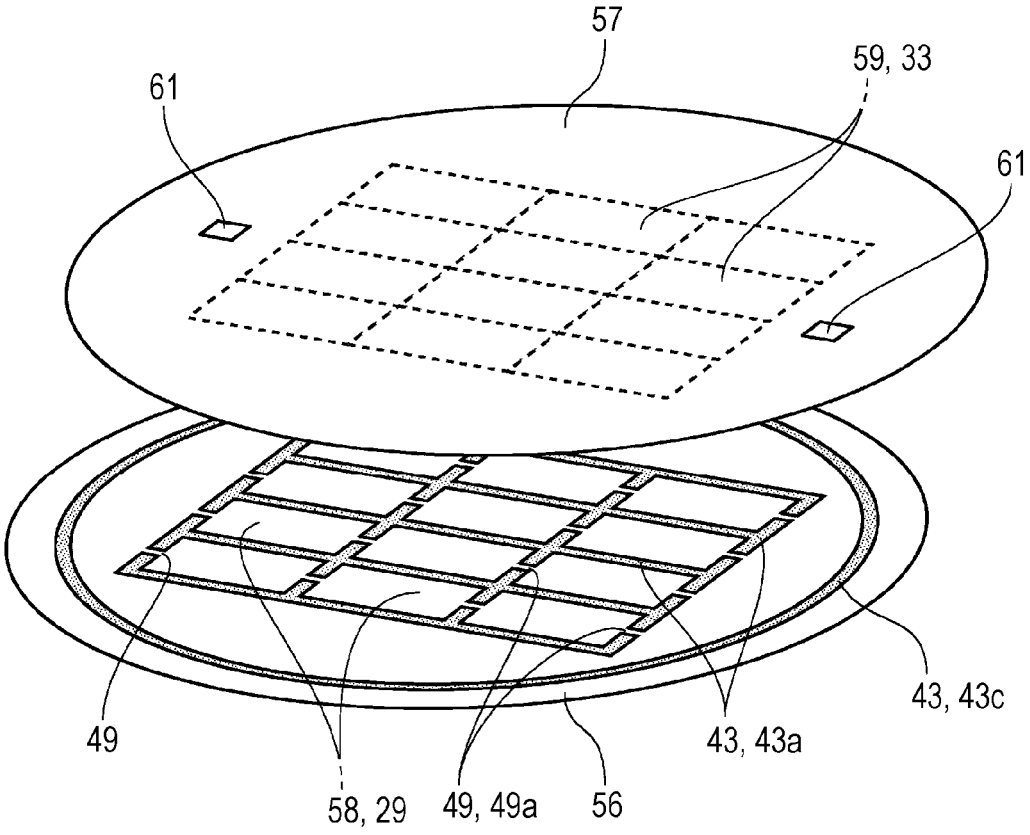
FIG. 5 is a perspective view describing bonding of a first mother substrate and a second mother substrate.
Figure 6:
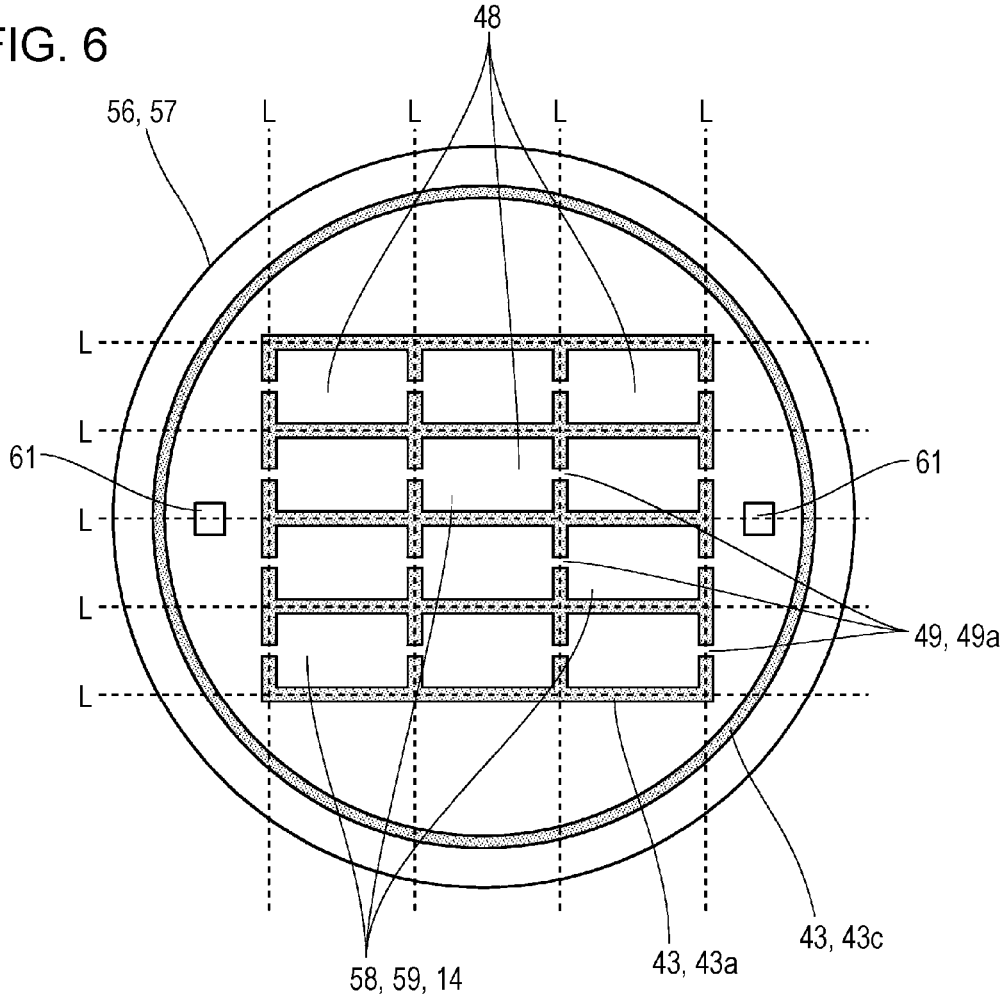
FIG. 6 is a plan view schematically illustrating the first mother substrate and the second mother substrate which are bonded.
Figure 7:
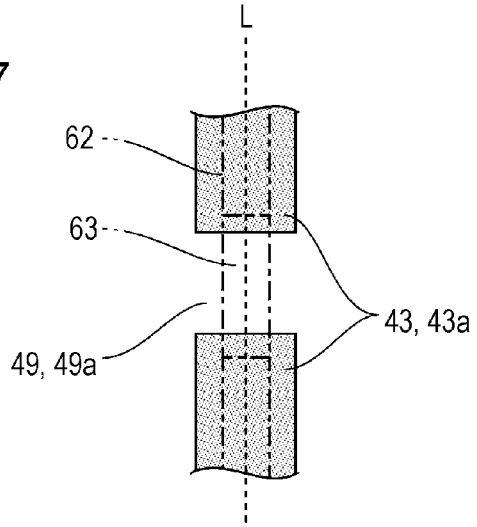
FIG. 7 is a plan view illustrating an enlarged main part of the first mother substrate and the second mother substrate which are bonded.
Figure 8:
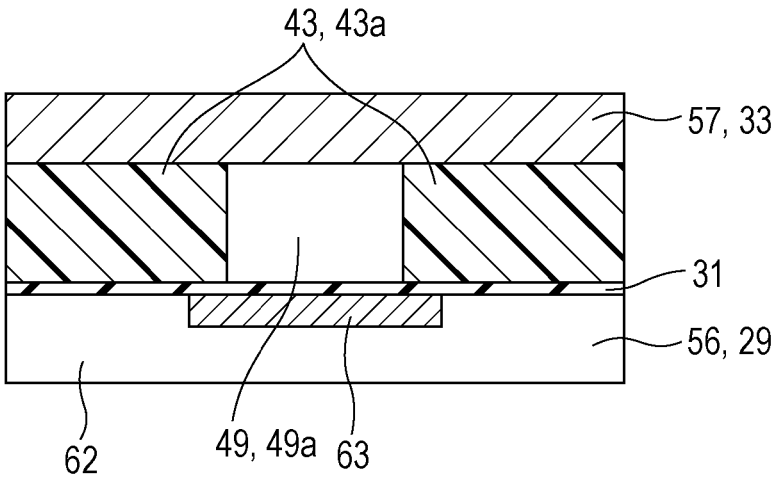
FIG. 8 is a sectional view illustrating an enlarged main part of the first mother substrate and the second mother substrate which are bonded.

Next, the manufacturing method of the recording head 3, particularly, a manufacturing method of the actuator unit 14 will be described in detail. FIG. 5 is a perspective view describing bonding of the first mother substrate 56 which becomes the pressure chamber forming substrate 29 and the second mother substrate 57 which becomes the sealing plate 33. FIG. 6 is a plan view schematically illustrating the first mother substrate 56 and the second mother substrate 57 which are bonded to each other. FIG. 7 is a plan view illustrating an enlarged main part (specifically, part corresponding to the process open hole 49*a*) of the first mother substrate 56 and the second mother substrate 57 which are bonded to each other. FIG. 8 is a sectional view illustrating an enlarged main part (specifically, part corresponding to the open hole 49) of the first mother substrate 56 and the second mother substrate 57 which are bonded to each other. Also, in FIG. 5 and FIG. 6, the adhesive 43 (that is, adhesive 43*b* inside space) inside a region which becomes the space 48 is omitted. In addition, a broken line in FIG. 5 to FIG. 7 indicates a division line L (referred to as cutting line). Further, the first mother substrate 56 and the second mother substrate 57 which are bonded to each other correspond to a bonded substrate in the invention, and the pressure chamber forming substrate 29 and the sealing plate 33, which are bonded to each other, obtained by dividing the first mother substrate 56 and the second mother substrate 57 which are bonded to each other with the division line L correspond to an individual bonded substrate in the invention.

As illustrated in FIG. 5, and the like, first, the vibration plate 31 is stacked on a surface in the first mother substrate 56 (in the embodiment, silicon wafer) which becomes the pressure chamber forming substrate 29. Next, the lower electrode layer 37, the piezoelectric layer 38, the upper electrode layer 39, the metal layer 44, and the like are stacked on the vibration plate 31. Moreover, these layers are formed through a semiconductor process (that is, film forming process, photolithography process, etching process, or the like). Accordingly, a plurality of first substrate regions 58 which become the pressure chamber forming substrate 29 after cutting are formed on the first mother substrate 56. Meanwhile, first, the penetration wiring 45 is formed in the second mother substrate 57 (in the embodiment, silicon wafer) which becomes the sealing plate 33. The penetration wiring 45 is formed by, for example, opening a penetration hole with laser, etching, or the like, and including a conductive material inside the penetration hole using electrolytic plating method, or the like. Moreover, in a process of forming the penetration hole, the atmosphere open hole 61 is formed at a position deviated from a region (second substrate region 59) which becomes the sealing plate 33. As illustrated in FIG. 5 and FIG. 6, the atmosphere open holes 61 in the embodiment are formed on both sides of a region where the plurality of second substrate regions 59 are arranged in the direction orthogonal to the nozzle row direction (horizontal direction in FIG. 5 and FIG. 6). Next, on a lower surface of the second mother substrate 57 (that is, surface facing the first mother substrate 56), the resin 40*a*, and the conductive film 40*b* are respectively formed by the semiconductor process, and the bump electrode 40 and the lower surface side wiring 47, and the like are formed. In addition, the upper surface side wiring 46, and the like are formed on an upper surface of the second mother substrate 57 (that is, surface opposite to surface facing the first mother substrate 56) by the semiconductor process. Accordingly, a plurality of the second substrate regions 59 which become the sealing plate 33 after cutting are formed on the second mother substrate 57.

If the plurality of first substrate regions 58 are formed on the first mother substrate 56, a process moves to an adhesive forming process. Specifically, on the surface of the first mother substrate 56, the adhesive 43 (that is, outer circumference adhesive 43*a*) is formed on an outer circumference, or the like of the first substrate region 58 deviated from a region corresponding to the process open hole 49*a* in which the adjacent open holes 49 are connected, so that the adjacent open holes 49 of the first substrate region 58 are connected to each other. More specifically, as illustrated in FIG. 6, the adhesive 43 is disposed on the division line L which is a boundary of the individual first substrate region 58 (that is, the actuator unit 14) so as to be remained as the outer circumference adhesive 43*a* of each of the actuator units 14, after the mother substrates being divided into the individual actuator unit 14. In other words, the adhesive 43 is disposed so that the adhesive 43 which becomes the outer circumference adhesive 43*a* of the first substrate region 58, and another adhesive 43 which becomes the outer circumference adhesive 43*a* of the first substrate region 58 adjacent to the one adhesive are connected to each other. Accordingly, in the first substrate region 58, a region which becomes the space 48 is partitioned by the adhesive 43 after bonding the substrates, and the adjacent spaces 48 communicate with each other through the process open hole 49*a* formed by the adhesive. Moreover, in the embodiment, the adhesive 43 is disposed so that the division line L which partitions the outer circumference of the first substrate region 58 passes through the center in a width direction of the adhesive 43. In addition, the process open hole 49*a* is formed to connect between the regions which become the spaces 48 adjacent to each other in the direction orthogonal to the nozzle row direction (horizontal direction of FIG. 5 and FIG. 6). In other words, the adhesive 43 which becomes the outer circumference adhesive 43*a* of the first substrate region 58 is disposed on a region deviated from a region corresponding to the process open hole 49*a*, so that the adjacent open hole 49 is connected thereto (communicates therewith) in the direction orthogonal to the nozzle row direction. Here, in the direction orthogonal to the nozzle row direction, the process open hole 49*a* of the outside (that is, side not adjacent to another first substrate region 58) of the first substrate region 58 positioned at the end portion is opened to a region of the outside of the corresponding first substrate region 58. Accordingly, the regions which become the spaces 48 of the first substrate region 58 are connected to each other in the direction orthogonal to the nozzle row direction through the process open hole 49*a* and open to the region of the outside of the first substrate region 58 on the end portion of the same direction.

Further, in the adhesive forming process, other than the adhesive 43 (that is, outer circumference adhesive 43*a*) on the division line L described above, the adhesive 43 is formed on the outer peripheral part of the first mother substrate 56 or the inside of the first substrate region 58. An adhesive for internal protection 43*c* formed on the outer peripheral part of the first mother substrate 56 is formed in a circle along the outer circumference of the first mother substrate 56 so as to include a region corresponding to the atmosphere open hole 61 of the first substrate region 58 and the second mother substrate 57. The inner space is separated from the outside than the adhesive for internal protection 43*c* by the adhesive for internal protection 43*c*, after the first mother substrate 56 and the second mother substrate 57 are bonded to each other. Accordingly, in subsequence processes, destroying of the piezoelectric element 32, wirings, or the like formed on the first substrate region 58 and the second substrate region 59 by infiltrating an etching solution which etches the first mother substrate 56, a peeling solution which peels a resist, or the like into the inside can be suppressed. In addition, the adhesive 43 formed inside the first substrate region 58 is the adhesive 43 which becomes the adhesive 43*b* inside the space (not illustrated). Moreover, a liquid photosensitive adhesive having photosensitivity and thermosetting property is applied on the surface of the first mother substrate 56 using a spin coater, and the like, and is temporally cured using heat, and then is exposed and developed, these adhesives 43 (that is, outer circumference adhesive 43*a*, adhesive 43*b* inside space, and adhesive for internal protection 43*c*) can be formed.

If the adhesive 43 is formed on the first mother substrate 56, the process moves to a substrate bonding process. Specifically, any one of the first mother substrate 56 or the second mother substrate 57 or both of them are moved while aligning relative positions. Also, the first mother substrate 56 and the second mother substrate 57 are pressurized from both sides and heated while providing the adhesive 43 therebetween. Accordingly, the adhesive 43 is cured in earnest, and the first mother substrate 56 and the second mother substrate 57 are bonded to each other with the adhesive 43. That is, a bonded substrate in the embodiment is formed. Here, there is a concern that air inside the first mother substrate 56, the second mother substrate 57, and the spaces 48 divided by the outer circumference adhesive 43*a* expand, and positions of the first mother substrate 56 and the second mother substrate 57 are deviated from each other by heating for curing the adhesive 43. However, in the embodiment, the space 48 of the individual actuator unit 14 divided by the outer circumference adhesive 43*a* is connected through the process open hole 49*a*, and is opened to a space surrounded by the adhesive for internal protection 43*c* on the outside of the region which becomes the actuator unit 14 by the process open hole 49*a* formed on the outer circumference adhesive 43*a* of the outermost circumference of the region which becomes the actuator unit 14. Also, the space surrounded by the adhesive for internal protection 43*c* is opened to the atmosphere through the atmosphere open hole 61 which is opened to a position deviated from the region which becomes the actuator unit 14 of the second mother substrate 57. Therefore, even if the air expands due to heating, the air inside the first mother substrate 56, the second mother substrate 57, and the space 48 divided by the adhesive 43 can be missed into the atmosphere.

When the first mother substrate 56 and the second mother substrate 57 are bonded to each other, in a removing process, a region deviated from a region corresponding to the process open hole 49*a* in the division line L by etching and the first mother substrate 56 a region corresponding to the pressure chamber 30 are removed in a plate thickness direction from a surface of an opposite side to the second mother substrate 57. For example, a resist layer which is patterned by being exposed and developed is formed on the surface of the first mother substrate 56 (surface of opposite side to the second mother substrate 57 side), the resist layer is etched as a mask (for example, wet etching), and then the resist layer is peeled off. Moreover, at this time, a protective film is attached to a surface of the second mother substrate 57 (surface of opposite side to the second mother substrate 57), so that the etching solution, the peeling solution, or the like are not infiltrated into between the first mother substrate 56 and the second mother substrate 57 through the atmosphere open hole 61. Accordingly, a groove 62 is formed on a region (that is, region overlapping with the outer circumference adhesive 43*a*) corresponding to the division line L of the first mother substrate 56. In addition, the pressure chamber 30 is also formed at the same time. As illustrated in FIG. 7, the groove 62 is formed to have a width, for example, several μm to several hundred μm so as to be narrower than a width of the outer circumference adhesive 43*a*. In addition, as illustrated in FIG. 8, a reinforcement part 63 is formed on a region corresponding to the process open hole 49*a* (open hole 49). The reinforcement part 63 in the embodiment is formed to be thinner than the first mother substrate 56 of a region deviated from the division line L. The reinforcement part 63 is formed, for example, by removing the first mother substrate 56 up to an intermediate of a thickness direction due to a half etching. As described above, the reinforcement part 63 of the first mother substrate 56 is formed, and thus, in subsequence wet etching, or the like, generation of cracks in the vibration plate 31 overlapping with the process open hole 49*a* can be suppressed, and further inserting the etching solution into the space 48 can be prevented. Moreover, the reinforcement part 63 is a part which becomes a part of the overlapping part 50 in the actuator unit 14 after being divided.

If a region corresponding to the division line L of the first mother substrate 56 is removed, in a division process, the first mother substrate 56 and the second mother substrate 57 which are bonded are cut along the division line L, so that the open hole 49 is opened to the end of the pressure chamber forming substrate 29 and the end of the sealing plate 33, and is divided into the individual actuator unit 14 (that is, pressure chamber forming substrate 29 and sealing plate 33 (individual bonded substrate in the invention)). Specifically, a fragile part is formed along the division line L of the second mother substrate 57 by laser, cutter, or the like, and divided by an expand-break. The expand-break is a method in which, for example, a sheet member having extensibility is adhered to any one of the first mother substrate 56 and the second mother substrate 57, the sheet member is pulled from the center in radial shape, and thus the first mother substrate 56 and the second mother substrate 57 are divided. Moreover, a method of dividing the first mother substrate 56 and the second mother substrate 57 is not limited to the expand-break method, and the substrates can be cut by dicing, or the like. Accordingly, the process open hole 49*a* is divided into the individual open hole 49, and the actuator unit 14 in which the end of the outside of the open hole 49 is opened to the end of the outside of the sealing plate 33 is created.

After that, the driving IC 34, the communication substrate 24, the nozzle plate 21, the head case 16, and the like are provided in the individual actuator unit 14. Specifically, the driving IC 34 is bonded to on the upper surface of the sealing plate 33 with the adhesive 54. In addition, the communication substrate 24 is bonded to the lower surface of the pressure chamber forming substrate 29, and the nozzle plate 21 is bonded to the lower surface of the communication substrate 24. Also, the head case 16 is provided on the upper surface of the communication substrate 24 in a state in which the actuator unit 14 is accommodated inside the accommodation space 17. As described above, the recording head 3 the recording head 3 in which the open hole 49 is opened to the end of the pressure chamber forming substrate 29 and the end of the sealing plate 33 can be manufactured.

As described above, in the manufacturing method of the recording head 3 of the invention, at the time of being divided into the individual actuator unit 14, it is divided so that the open hole 49 is opened to the end of the pressure chamber forming substrate 29 and the end of the sealing plate 33, and thus the miniaturized actuator unit 14 can be manufactured. That is, since the adhesive 43 is disposed on the division line L, compared to a case in which the adhesive 43 is disposed avoiding the division line L, the actuator unit 14 can be miniaturized, and the recording head 3 can be also miniaturized. In addition, since the process open hole 49*a* in which the open holes 49 in a region which becomes the adjacent actuator unit 14 are connected to each other is formed, making the space 48 of a region which becomes each actuator unit 14 possible to communicating. Accordingly, each space 48 can be opened to the outside (that is, atmosphere) of the mother substrate through the atmosphere open hole 61 of the second mother substrate 57. As a result, at the time of applying heat to the adhesive 43, air inside the space 48 can be missed to the outside of the mother substrate. In addition, compared to a case in which the atmosphere open hole 61 penetrating the mother substrate is provided in each region which becomes the actuator unit, deterioration of strength of the mother substrate can be suppressed. Further, before the division process, the first mother substrate 56 is removed in the plate thickness direction along the division line L, and thus division is easily performed when the two mother substrates which are bonded to each other in the division process are divided into the individual actuator unit 14. In addition, since the reinforcement part 63 corresponding to the process open hole 49*a* is not completely removed and remained as it is, in a state of the mother substrate before being divided, generation of cracks, clefts, or the like in a region corresponding to the process open hole 49*a* where the strength is likely to be weakened can be suppressed. For example, the corresponding adhesive 43 is contracted at the time of curing the adhesive 43, even when stress is generated in the end of the adhesive 43, that is, the end of the process open hole 49*a*, a defect of damage of the mother substrate can be suppressed.

Figure 9:
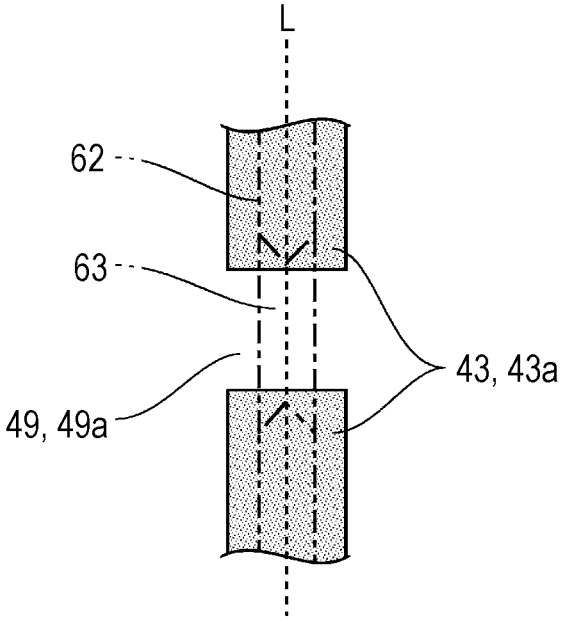
FIG. 9 is a plan view illustrating an enlarged main part of a first mother substrate and a second mother substrate which are bonded in a second embodiment.

Moreover, in the embodiment, in the adhesive forming process, the adhesive 43 is formed on the first mother substrate 56, but it is not limited thereto. In the adhesive forming process, the adhesive may be formed on the second mother substrate 57. In addition, the atmosphere open hole 61 is provided on the second mother substrate 57, but it is not limited thereto. The atmosphere open hole can be also provided on the first mother substrate. Further, a shape of the reinforcement part 63 is not limited to the embodiment described above. For example, in a second embodiment illustrated in FIG. 9, the reinforcement part 63 is formed so as to be easily divided along the division line L.

Specifically, the reinforcement part 63 of the second embodiment is formed to have a length (that is, length in direction along the division line L) which is gradually shorter toward substantially center of a width direction of the groove 62 formed on the first mother substrate 56. In other words, a length of the center portion in a width direction of the reinforcement part 63 becomes shorter than a length of both end portions in a width direction of the reinforcement part 63. Therefore, strength of the center portion in the width direction of the reinforcement part 63 becomes the weakest. Also, the division line L is set the center in the width direction of the reinforcement part 63. Accordingly, in the division process, when the first mother substrate 56 and the second mother substrate 57 which are bonded to each other are respectively divided, the reinforcement part 63 is easily divided along the division line L. In the embodiment, the division line L is set in the center in the width direction of the reinforcement part 63, and thus the reinforcement part 63 is uniformly divided. As a result, after being divided, difference of the size in the overlapping part 50 of the actuator unit 14 can be suppressed. Moreover, another configuration is the same as that of the first embodiment, and thus description thereof will be omitted.

Figure 10:
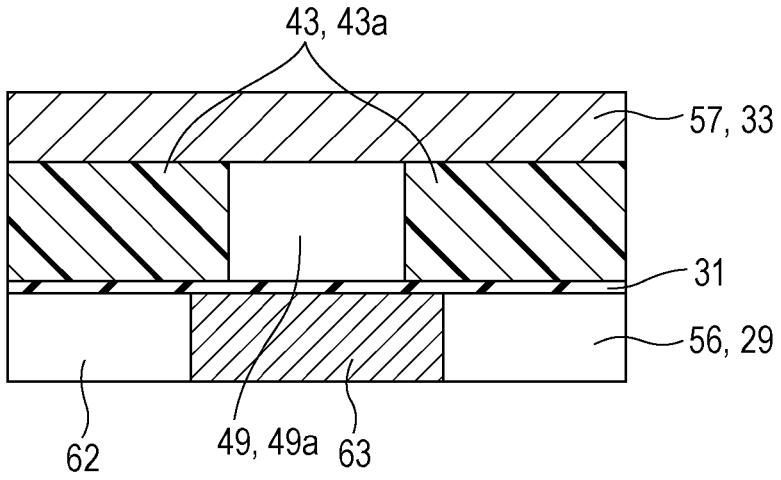
FIG. 10 is a sectional view illustrating an enlarged main part of a first mother substrate and a second mother substrate which are bonded in a third embodiment.

In addition, in a third embodiment illustrated in FIG. 10, the reinforcement part 63 is not removed in a thickness direction, and is provided to be therewith in the same thickness as the thickness of another part of the first mother substrate 56. Therefore, after being divided into the actuator unit 14, the thickness of the overlapping part 50 is the same as a thickness of another part of the pressure chamber forming substrate 29. In this way, in a state of the mother substrate before being divided, strength of a region corresponding to the process open hole 49*a* can be increased, and thus generation of cracks, clefts, or the like can be further suppressed. Moreover, another configuration is the same as that of the first embodiment, and thus description thereof will be omitted. In addition, even in this embodiment, same as the second embodiment, a length of the center portion in the width direction of the reinforcement part 63 can be shorter than lengths of both end portions in the width direction of the reinforcement part 63.

Figure 11:
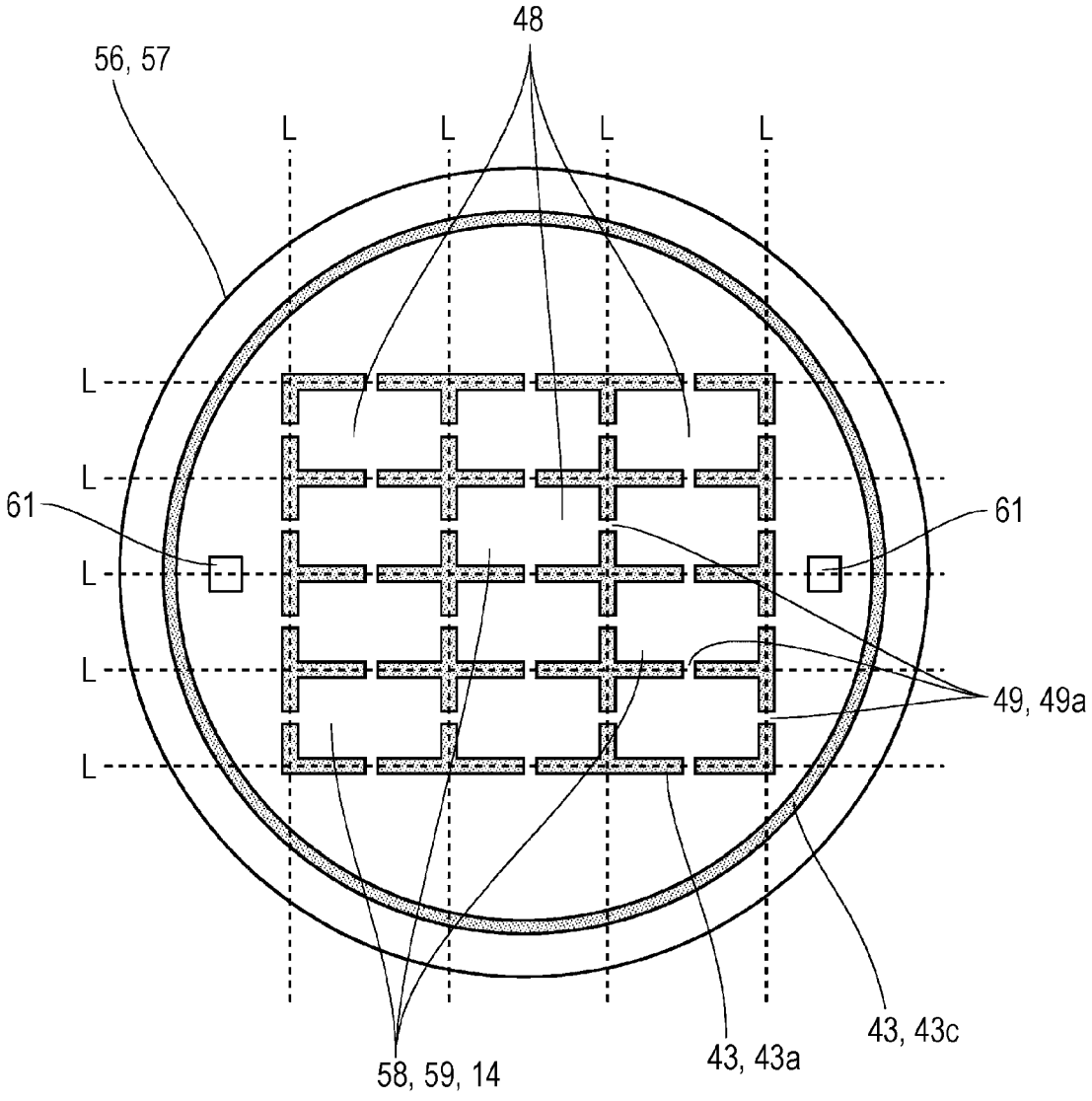
FIG. 11 is a plan view schematically illustrating a first mother substrate and a second mother substrate which are bonded in the third embodiment.

However, a position of the process open hole 49*a* (open hole 49) or a shape of the adhesive 43 is not limited to the first embodiment described above. For example, in the third embodiment illustrated in FIG. 11, the process open hole 49*a* which connects the first substrate regions 58 adjacent to each other in the direction orthogonal to the nozzle row direction (horizontal direction in FIG. 11), and the process open hole 49*a* which connects the first substrate regions 58 adjacent to each other in the direction orthogonal to the nozzle row direction (vertical direction in FIG. 11) is formed. That is, in both of horizontal and vertical directions, the spaces 48 of the region which becomes the actuator unit 14 are connected to each other by the process open hole 49*a*. Also, in the both of horizontal and vertical directions, the process open hole 49*a* of the outside (that is, side not adjacent to the first substrate region 58) of the first substrate region 58 which is positioned at the end portion is opened to the region of the outside of the corresponding first substrate region 58. Therefore, after being divided in the actuator unit 14, the open hole 49 is provided on four sides of the actuator unit 14 in a plan view. Moreover, another configuration is the same as the first embodiment described above, and thus description thereof will be omitted.

Figure 12:
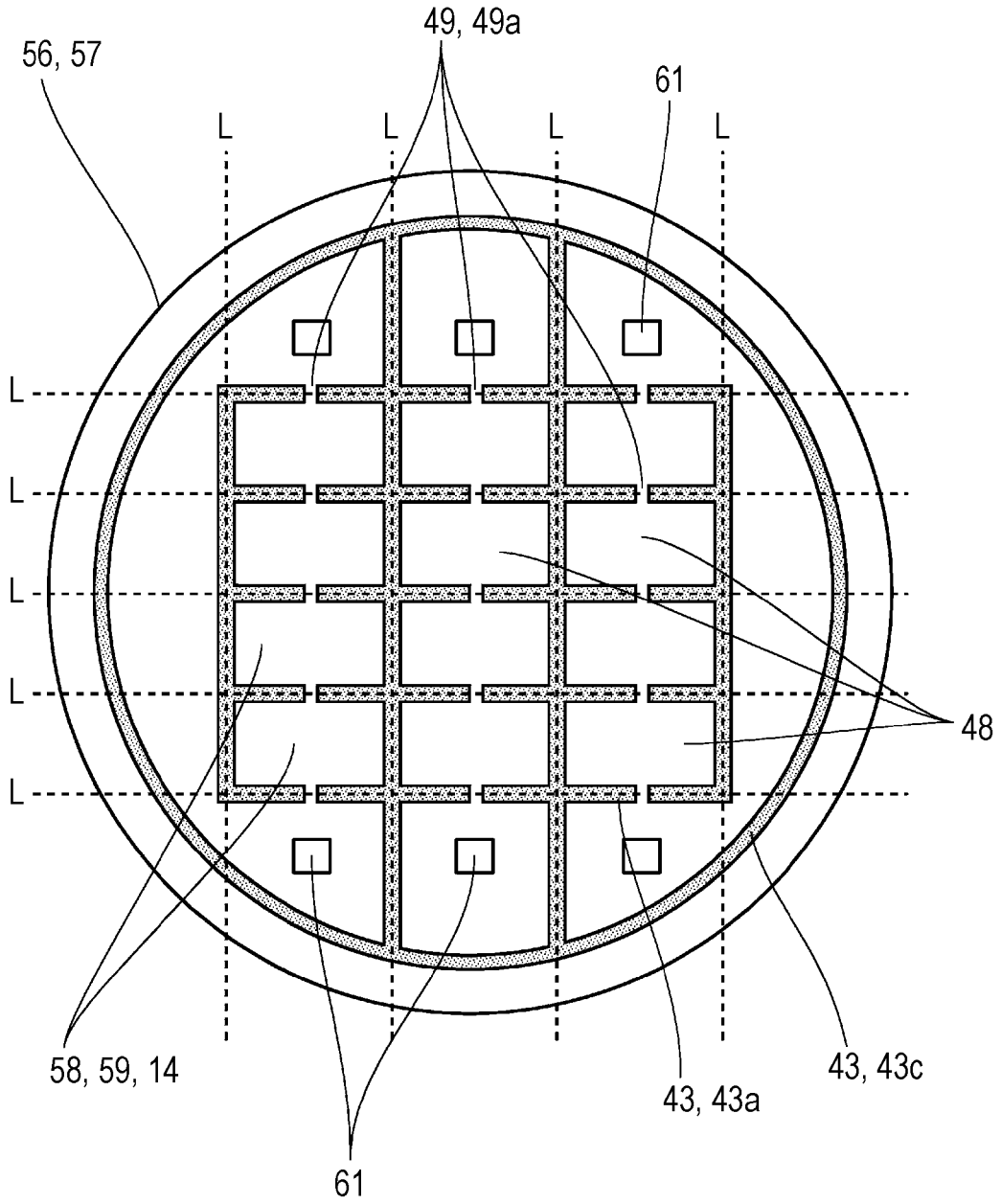
FIG. 12 is a plan view schematically illustrating a first mother substrate and a second mother substrate which are bonded in a fourth embodiment.

In addition, in a fourth embodiment illustrated in FIG. 12, the space inside further than the adhesive for internal protection 43*c* is divided into the plurality of spaces, and each space is opened to the atmosphere. Specifically, the process open hole 49*a* (the open hole 49) in the embodiment is formed so as to connect the adjacent first substrate regions 58 to each other in the nozzle row direction (vertical direction in FIG. 12). That is, the adjacent spaces 48 of a region which becomes the actuator unit 14 in the vertical direction are connected to each other by the process open hole 49*a*. Also, in the vertical direction, the process open hole 49*a* on the outside (that is, side not adjacent to another first substrate region 58) of the first substrate region 58 positioned at the end portion is opened to the region of the outside of the corresponding first substrate region 58. In addition, the adhesive 43 (outer circumference adhesive 43*a*) which partitions the first substrate regions 58 adjacent to each other in the direction orthogonal to the nozzle row direction (horizontal direction in FIG. 12) extends in the vertical direction, and is connected to the adhesive for internal protection 43*c*. The space inside further than the adhesive for internal protection 43*c* is divided into a plurality (three, in the embodiment) of small spaces by the adhesive 43 extended in the vertical direction. Also, the atmosphere open hole 61 which opens each small spaces to the atmosphere is formed on a region deviated from a region which becomes the actuator unit 14 in each small space. Accordingly, each small space is opened to the atmosphere. When the spaces are divided into each small space as described above, even when the etching solution is infiltrated into the small space, infiltration of the etching solution into another small space can be suppressed. That is, the number of regions (the number of chips) being immersed in the etching solution are decreased more than that of in each embodiment illustrated in FIG. 5, FIG. 6, FIG. 11, and the like. As a result, yield is further improved. Moreover, another configuration is the same as that of the first embodiment described above, description thereof will be omitted.

Moreover, in the embodiment described above, in the first mother substrate 56 and the second mother substrate 57, the first substrate region 58 and the second substrate region 59 are illustrated as being arranged four of them in the vertical direction and three of them in the horizontal direction, but it is not limited thereto. The number of the first substrate region and the second substrate region (that is, actuator unit) arranged on the first mother substrate and the second mother substrate can be appropriately designed according to a size of the first substrate region and the second substrate region.

In addition, hitherto, a configuration, in which ink which is a type of liquid is ejected from the nozzle 22 by displacing the piezoelectric element 32 which is a type of a driving element provided on the first substrate (the pressure chamber forming substrate 29 on which the vibration plate 31 is stacked), is exemplified, but it is not limited thereto. If an MEMS device in which the first substrate and the second substrate are bonded to each other by the adhesive includes the space accommodating the driving element, the invention can be applied thereto. For example, the invention can be also applied to a device which applies the driving element to a sensor for detecting pressure change, vibration, displacement, or the like.

Also, hitherto, the ink jet type recording head 3 is exemplified as the liquid ejecting head, but in the invention can be applied to other liquid ejecting heads provided with the piezoelectric element. For example, the invention can be applied to a color material ejecting head used for manufacturing color filters such as liquid crystal displays, an electrode material ejecting head used for forming electrodes such as an organic electro luminescence (EL) display, and a surface emission display (FED), a bioorganic material ejecting head used for manufacturing a biochip (biochemical element), and the like. The color material ejecting head for a display manufacturing apparatus ejects a solution of each color material of red (R), green (G), and blue (B) which are a type of liquid. In addition, the electrode material ejecting head used for forming electrodes ejects the electrode material of liquid type, which is a type of liquid, and the bioorganic material ejecting head used for manufacturing the biochip ejects a solution of bioorganic material of liquid type, which is a type of liquid.

What is claimed is:

1. An MEMS device comprising:

a first substrate provided with a driving element; and a second substrate protecting the driving element are bonded to each other with an adhesive, wherein the driving element is formed inside a space surrounded by the adhesive between the first substrate and the second substrate, wherein an open hole which communicates with the space and an outside of the adhesive is formed in the adhesive, and wherein an end of an outside of the open hole is provided to be with an end of the first substrate and an end of the second substrate.

2. The MEMS device according to claim 1, wherein the first substrate is configured with a main substrate and a stacked member which is stacked on the main substrate, and wherein an end of the main substrate is provided to be with the end of the outside of the open hole.

3. The MEMS device according to claim 2, wherein the first substrate includes an overlapping part overlapping with at least open hole in a stacking direction of the first substrate, the adhesive, and the second substrate, and wherein an end of the overlapping part of the main substrate is provided to be with the end of the second substrate, and an end of a part deviated from the overlapping part of the main substrate is formed on the inside further than the end of the second substrate.

4. A liquid ejecting head comprising a structure of the MEMS device according to claim 1, wherein the driving element is a piezoelectric element, the first substrate is a substrate including a pressure chamber forming substrate in which a pressure chamber is provided on a region corresponding to the piezoelectric element, and the open hole is an atmosphere open hole which opens a space to an atmosphere.

5. A liquid ejecting head comprising a structure of the MEMS device according to claim 2, wherein the driving element is a piezoelectric element, the first substrate is a substrate including a pressure chamber forming substrate in which a pressure chamber is provided on a region corresponding to the piezoelectric element, and the open hole is an atmosphere open hole which opens a space to an atmosphere.

6. A liquid ejecting head comprising a structure of the MEMS device according to claim 3, wherein the driving element is a piezoelectric element, the first substrate is a substrate including a pressure chamber forming substrate in which a pressure chamber is provided on a region corresponding to the piezoelectric element, and the open hole is an atmosphere open hole which opens a space to an atmosphere.

* * * * *